US006892783B1

(12) United States Patent
Comeau et al.

(10) Patent No.: US 6,892,783 B1
(45) Date of Patent: May 17, 2005

(54) MULTIPLE PANEL TRACK SYSTEM FOR A WINDOW COVERING ASSEMBLY

(76) Inventors: Paul E. Comeau, 67 Kalmer Rd., Warwick, RI (US) 02886; William F. Uecker, 811 River Terrance Dr., McHenry, IL (US) 60050

( * ) Notice: Subject to any disclaimer, the term of this patent is extended or adjusted under 35 U.S.C. 154(b) by 0 days.

(21) Appl. No.: 10/358,909

(22) Filed: Feb. 5, 2003

(51) Int. Cl.[7] ..... A47H 1/00
(52) U.S. Cl. ..... 160/126; 160/197; 160/98
(58) Field of Search ..... 160/184, 124, 160/126, 98, 108, 197, 345

(56) References Cited

U.S. PATENT DOCUMENTS 3,348,603 A 10/1967 Ford et al.
3,574,887 A 4/1971 Schindlauer
3,883,924 A * 5/1975 Grabman ..... 160/126 X
3,911,991 A 10/1975 Malferrai
4,221,255 A * 9/1980 Barkemeyer ..... 160/197
4,546,809 A * 10/1985 Hadfield ..... 160/126
5,109,910 A 5/1992 Tortorella et al.
6,192,631 B1 2/2001 Kenkel et al.
6,256,931 B1 7/2001 Kenkel et al.

* cited by examiner

*Primary Examiner*—David Purol
(74) *Attorney, Agent, or Firm*—Mathew R. P. Perrone, Jr.

(57) ABSTRACT

A nested multiple panel track system supporting a desired window covering provides for a window covering assembly capable of holding even an extremely heavy window covering, and providing an efficient operation therefor.

12 Claims, 12 Drawing Sheets

MULTIPLE PANEL TRACK SYSTEM FOR A WINDOW COVERING ASSEMBLY

This invention relates to a window covering, and more particularly to a multiple panel track system for a window covering assembly, which can be mounted within a window frame.

BACKGROUND OF THE INVENTION

A typical window covering is a blind or a curtain. When the covering is positioned to be placed over a window, a covering support is mounted in the window frame. The window frame supports the glass or other transparent material used for the window. The covering support supports a blind or a curtain, which can be used to prevent or permit viewing through the window as desired.

Major problems exist with window covering supports. Generally, a narrow covering support provides the best mounting capability for within the window frame. However, the narrower covering supports are not always substantial enough to brace heavier weight window coverings.

Furthermore, it is difficult to provide a narrow support for window coverings on a large window with a large expanse of glass. The weight of the window covering, needed to traverse a large window, almost always mandates a substantial covering support. However, substantial covering supports may not be narrow enough to be mounted within the window frame. The covering support must be strong and capable of holding the window covering, whatever its weight.

With a covering support, width and strength are generally in direct proportion to each other. A sacrifice in width of a covering support usually leads to a corresponding sacrifice in strength. Concentration on strength usually leads to a covering support, which is too wide to be mounted flush within the window frame.

Thus, it is very desirable to provide a strong covering support, that is narrow enough to allow mounting within the window frame. This strong covering support must be able to support a heavy window covering, while, at the same time, it must fit flush within the window frame.

Even if such a covering support can be developed, the curtain or the blind therein must be operable. In other words, it is very desirable for the window covering support to facilitate the positioning of window treatment to allow or prevent viewing through the window.

Thus, the window treatment support also functions as a positioning device for the window treatment. Typical of the prior art positioning devices are the side pull cord devices. These cords are known to be safety hazards, especially for small children. A small child can playfully, accidentally, or purposely wrap that cord around his or her neck. If the cord is then shortened by the mechanism in the positioning device, a strangulation can occur, which can result in death.

These positioning devices are typically at the end of the window covering support. Such a location for the positioning device makes it very attractive to a small child. It is very desirable to provide a suitable and durable positioning device for a window covering.

Durability is also a required or desired advantage of implements or positioning devices used to cover or uncover a window, as desired. The longer a device will last and function properly, the more acceptable it will be to consumers.

It is, therefore, very desirable to provide a positioning device, which minimizes danger, especially for a small child, while at the same time, providing the desired reliability and durability.

SUMMARY OF THE INVENTION

Among the many objectives of this invention is the provision of a multiple panel track system for a window covering assembly capable of being efficiently attached to a window frame.

A further objective of this invention is the provision of a multiple panel track system for a window covering assembly having sufficient strength to hold a heavy window shade.

Yet a further objective of this invention is the provision of a multiple panel track system for a window covering assembly capable of supporting a heavy curtain.

A still further objective of this invention is the provision of a multiple panel track system for a window covering assembly with a reduced size to allow mounting within the window frame.

Also, an objective of this invention is the provision of a reliable positioning device for a window covering.

Another objective of this invention is the provision of a safe positioning device for a window covering.

These and other objectives of the invention (which other objectives become clear by consideration of the specification, claims and drawings as a whole) are met by providing a nested multiple panel track system for a window covering assembly capable of holding a desired window covering. The nested multiple panel track system for a window covering assembly has a centrally situated positioning device capable of moving the window covering as desired.

BRIEF DESCRIPTION OF THE DRAWINGS

FIG. 18 depicts an exploded view of the pulley system 314 with pulleys 316 mounted on the adjustable end caps 200 with cord 318 strung between.

Throughout the figures of the drawings, where the same part appears in more than one figure of the drawings, the same number is applied thereto.

DESCRIPTION OF THE PREFERRED EMBODIMENTS

Figure 1:
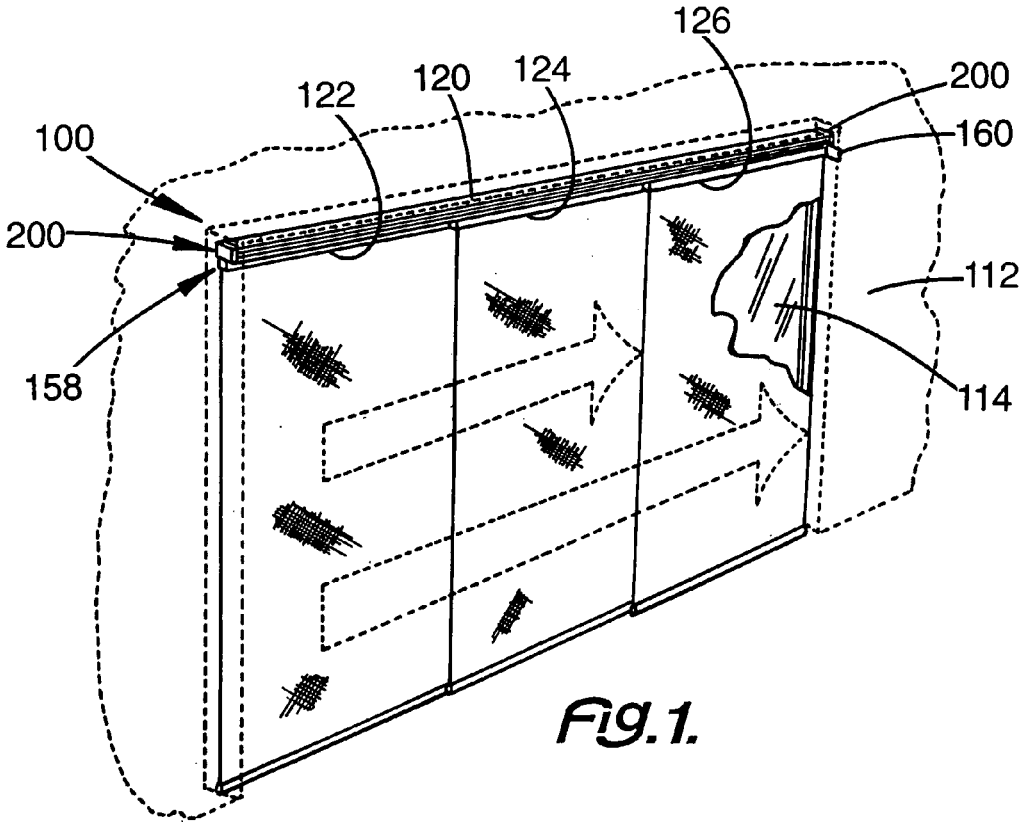
FIG. 1 depicts a perspective view of the sole multiple panel track system for a window covering assembly 100 of this invention showing track assembly 158 thereof fully deployed.

With the multiple panel track system for a window covering assembly having nested tracks in the covering assembly, which covering support is, in turn, mounted in the window frame, great advantages are obtained. By window frame is meant the area around a window or other architectural opening in a building. By building is meant a commercial or residential building. The window frame or the vicinity thereof is customarily the location of window covering assembly.

Several sets of window coverings may be set in the multiple panel track system for a window covering assembly, while the support remains narrow enough to be mounted within the window frame as opposed to being mounted upon the face of it.

The multiple panel track system for a window covering assembly has three carrier receivers, which are nested. Such a nesting structure permits the window covering assembly to be narrower. In each track is mounted a carrier, which permits panels to be positioned to be positioned either to cover a window in order to prevent viewing therethrough, that is a deployed position; or be pulled to the side of a window in order to permit viewing therethrough, which is to say a retracted position is thus provided.

Within each track of the multiple panel track system for a window covering assembly is mounted a carrier. To each carrier, may be attached a suitable type of the covering material in any appropriate shape. The covering material in the carrier may be any suitable curtain material, whether the material is opaque, translucent, or transparent. In this fashion, the window covering assembly is used efficiently.

Each carrier in a track of the multiple panel track system may have the same type of material or a different type of material. Preferably, the material is the same type of material for each carrier in the multiple panel track system. Each covering material in the carrier may be opaque, translucent, or transparent; or even combinations thereof.

Each carrier is adapted to fit within a track of the multiple panel track system for a window covering assembly. With the nesting configuration of the tracks, such a structure is very compact. Within a carrier, are a guide cam and a locking cam to limit the movement thereof in order to permit appropriate use of the carrier, within the multiple panel track system for a window covering assembly. In this fashion, the covering, as mounted on or in the carrier, will remain in the proper position as set by the homeowner.

If desired, a center pull unit may be used with the multiple panel track system for a window covering assembly. The center pull unit can permit movement of each carrier within its respective track. The fixed reel and the movable wheel of the center pull unit combine with the carrier; and permit operation and assembly of the window covering in the multiple panel track system for a window covering assembly, an appropriately movable fashion.

The carrier has a track mount, and a curtain receiver cooperating to form the carrier. The track mount fits within a track of the multiple panel track system for a window covering assembly. The curtain holder extends from the track mount and receives any desired covering. Caps, which are releasably secured within each track of the multiple panel track system for a window covering assembly, secure the curtain panel within the curtain holder.

If desired, an end cap can be slidably mounted in the end of the multiple panel track system for a window covering assembly and permit extension thereof. Such extension permits the carrier to be customized to fit an odd-sized window by a typical homeowner in a do-it-yourself fashion.

It is also possible to provide for a center pulling device for the multiple panel track system for a window covering assembly. With a centrally located cord assembly fully adapted to fit within the track, the problems of an end pull device are avoided. The cord from the first carrier travels freely to the cord on the second carrier and then to the third carrier. The central pulling of the multiple panel track system for a window covering assembly is easily permitted. A cord is attached to a carrier and fixed to a cord sleeve in order to achieve the central pulling for opening and closing the curtain.

Also, such a structure permits a number of the panels to be used. For example, with the pulling of a six panel blind and separating of the center by pulling on the center, the carrier structure permits such a structure for moving the covering from deployed position to retracted position on the window, and the reverse thereof. It is also possible to supplement the multiple panel track system for a window covering assembly, with a blind thereon in the window frame in order to provide for an opaque situation, which can prevent viewing through the window, if desired.

In the six panel blind, the six panels may separate into two sets of three. For example, three adjacent panels may be retracted to one side of the window, while the other three panels are retracted to an opposing side of the window. Thus, two of the panels move within the same track, but in oppositely, generally horizontal direction with their respective tracks.

Figure 2:
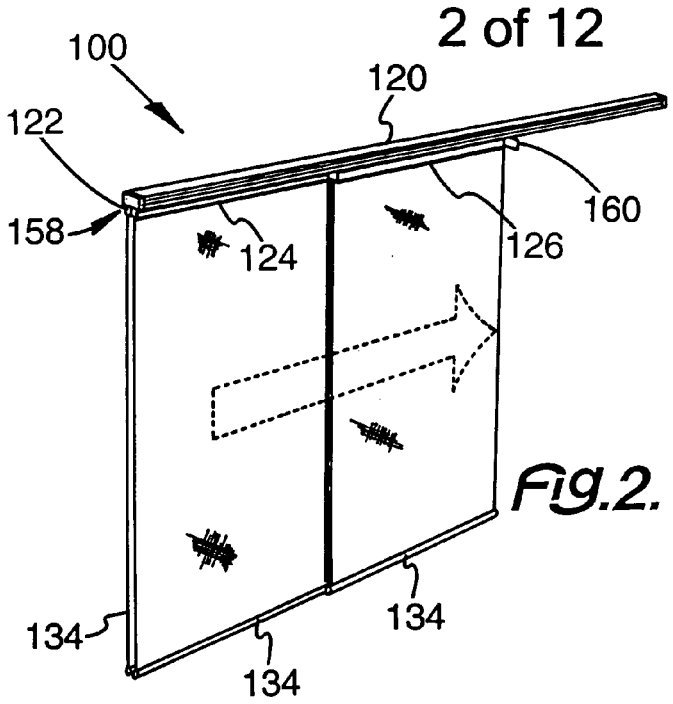
FIG. 2 depicts a perspective view of the sole multiple panel track system for a window covering assembly 100 of this invention showing track assembly 158 thereof partially deployed.
Figure 3:
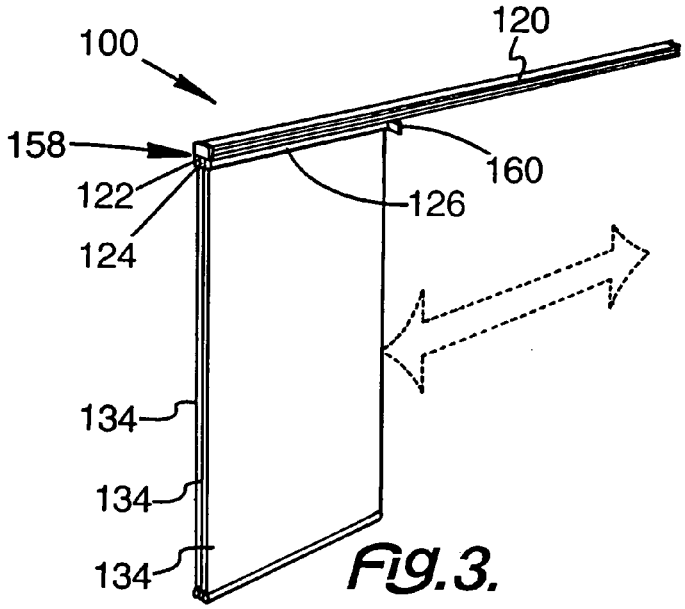
FIG. 3 depicts a perspective view of the sole multiple panel track system for a window covering assembly 100 of this invention showing track assembly 158 thereof fully retracted.

Referring now to FIG. 1, FIG. 2 and FIG. 3, sole multiple panel track system for a window covering assembly 100 is mounted within window frame 112. Window frame 112 serves to support window glass 114 therein. Multiple panel track system for a window covering assembly 100 has a track support 120 therein adapted to receive track assembly 158. Two adjustable end caps 200, enclose the track assembly 158 within track support 120. Track assembly 158 comprises first carrier track 122; second carrier tract 124 and third carrier track 126. Positioned at the end of third carrier track 126 is pull cap 160, which is used as a hand grip in deploying and retracting the window covering. FIG. 1 portrays track assembly 158 completely deployed. FIG. 2 displays track assembly 158 partially deployed. FIG. 3 displays track assembly 158 completely retracted. From each of first carrier track 122, second carrier track 124 and third carrier track 126 is suspended a curtain panel 134.

Figure 4:
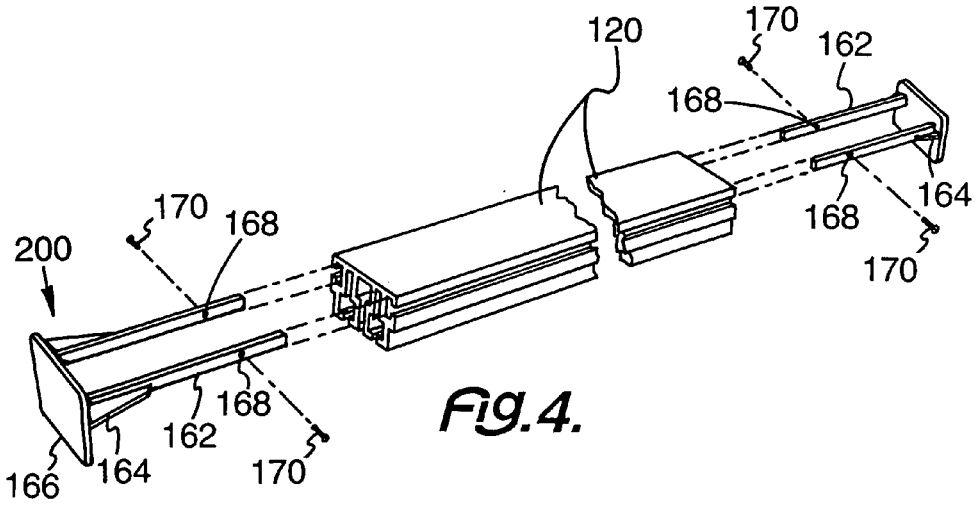
FIG. 4 depicts a perspective view of the sole multiple panel track system for a window covering assembly 100 of this invention with adjustable end cap 200.

FIG. 4 is an exploded view of track support 120 with adjustable end caps 200. Each end cap 200 has a bottom base 166 with substantially rectangular arms 162 extending therefrom, which arms 162 are perpendicular to the base 166 and inserted into the track support 120. Positioned in the center of the outside of each arm is a generally triangular shaped wing 164, whose base is attached to bottom base 166. Wing 164 has a shape similar to an isosceles triangle and provides rigidity for the arm 162. Near the top of each arm is a small orifice 168, which lock arm screw 170 is inserted into to lock the position of the adjustable end cap 200 in track support 120.

Figure 5:
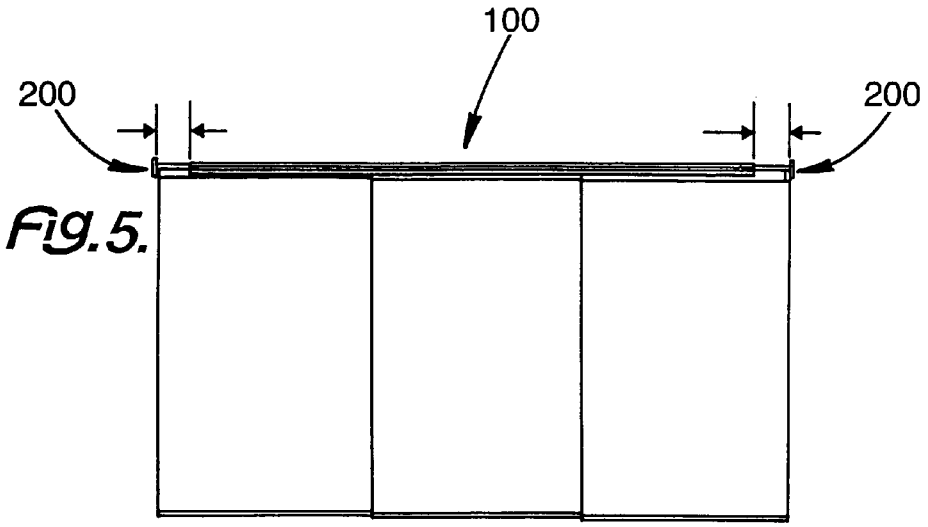
FIG. 5 depicts a side view of the sole multiple panel track system for a window covering assembly 100 of this invention with adjustable end cap 200.

FIG. 5 demonstrates how the adjustable end cap 200 allows the sole multiple panel track system for a window covering assembly 100 to be customized for odd-sized windows.

Figure 6:
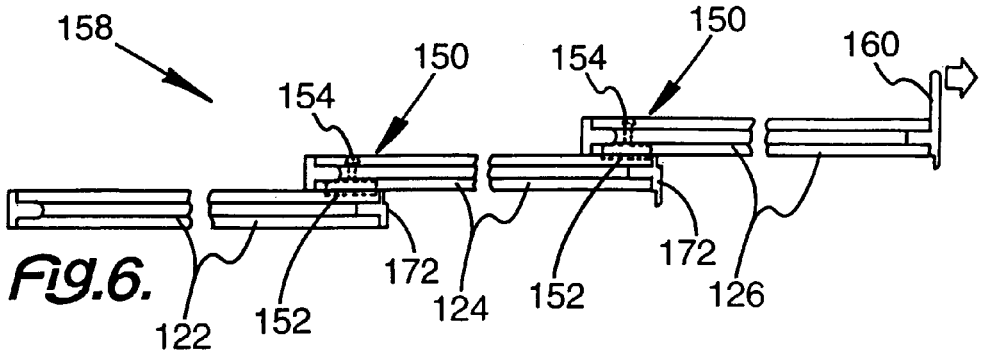
FIG. 6 depicts a bottom plan view of the track assembly 158 fully deployed.

FIG. 6 shows a bottom view of track assembly 158 fully deployed. Track assembly 158 includes first carrier track 122, second carrier track 124, and third carrier track 126. Situated at the right ends of carrier track 122 and carrier track 124 is catch assembly 150. Catch assembly 150 contains a rectangular shaped catch block 152 with a screw aperture, into which catch screw 154 is inserted. The catch assembly 150 protrudes out and butts against catch cap 172. Catch cap 172 is located on both ends of carriers 122 and 124 and on the left end of carrier 126.

When the track assembly 158 is completely deployed, the catch assembly 150 located on the second carrier track 124 buts up against catch cap 172, which is positioned at the right end of first carrier track 122. In the same manner, the catch assembly 150 located on third carrier 126 protrudes out and butts against the catch cap 172 which is positioned on the right end of second carrier track 124. Positioned at the right end of third carrier track 126 is pull cap 160.

Figure 7:
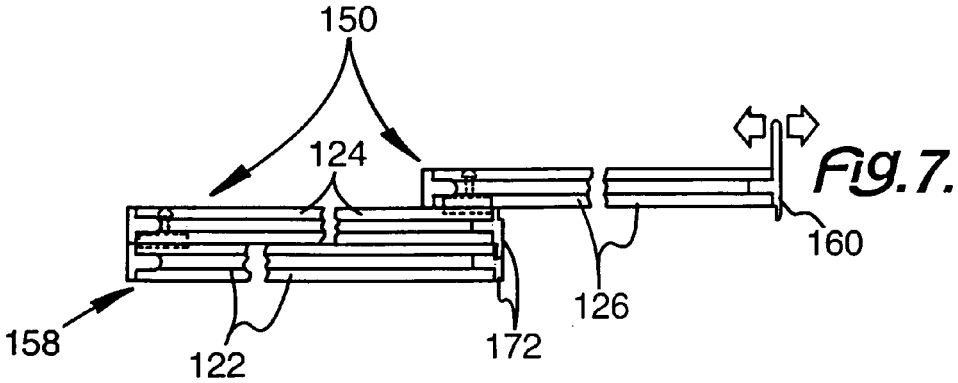
FIG. 7 depicts a bottom plan view of the track assembly 158 partially deployed.

FIG. 7 shows track assembly 158 partially deployed. The catch assembly 150 located third carrier 126 butts up against the catch cap 172 located on the right of second carrier 124. The catch assembly 150 located on third carrier 126 protrudes out and butts against the catch cap 172 which is positioned on the right end of second carrier track 124.

Figure 8:
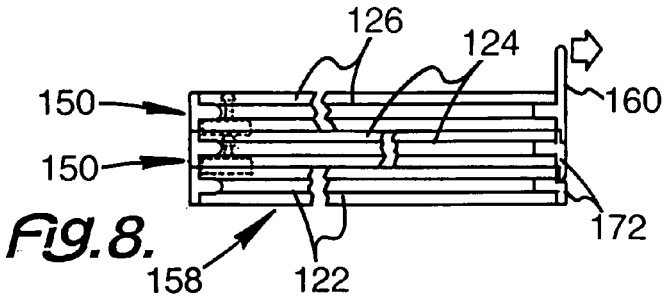
FIG. 8 depicts a bottom plan view of the track assembly 158 completely retracted.

FIG. 8 displays track assembly 158 completely retracted. The catch assembly 150 located second carrier 124 butts up against the catch cap 172 located on the left of first carrier 122. The catch assembly 150 located on third carrier 126 protrudes out and butts against the catch cap 172, which is positioned on the left end of second carrier track 124.

In another modification, the positions of the catch caps 172, catch assembly 150 and pull cap 160 may be reversed to the other ends of the track assemblies to allow movement to the left to deploy the track assembly and movement to the right to retract it.

Figure 9:
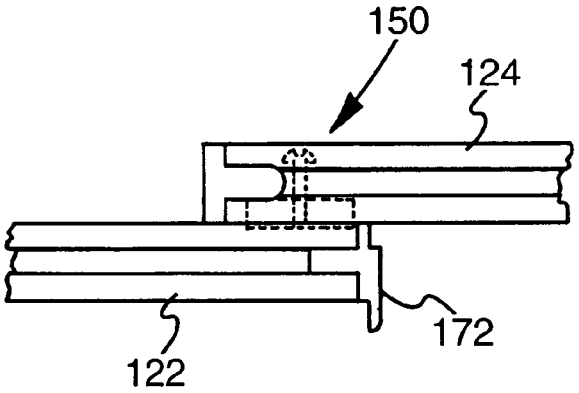
FIG. 9 depicts a bottom plan view of catch assembly 150 for carrier 118 of the sole multiple panel track system for a window covering assembly 100 of this invention.

FIG. 9 shows an enlarged view of catch assembly 150 located on second track carrier 124 butting up against catch cap 172 located on the right end of first track carrier 122.

Figure 10:
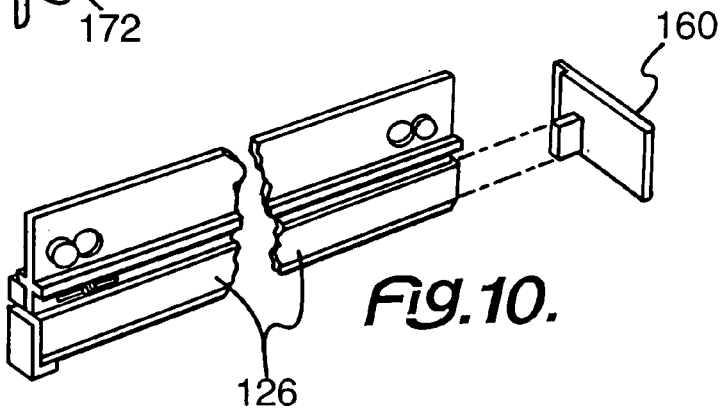
FIG. 10 displays exploded perspective view of carrier track 126 with pull cap 160 displayed.

FIG. 10 displays third track carrier 126 with pull cap 160. Pull cap 160 serves the dual purpose of budding up against the catch cap 172 located on the right end of carrier track 124 when carrier track 126 is completely retraced and provides a place for the homeowner to grasp when the multiple panel track system for a window covering assembly 100 is being deployed and retracted.

Figure 11:
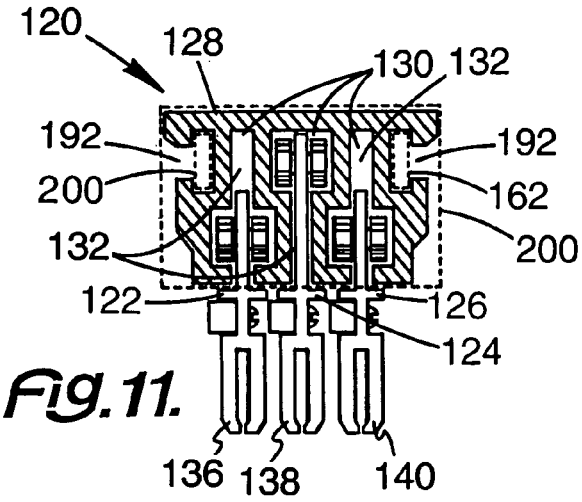
FIG. 11 depicts an end, plan, partially cross-sectioned view of the sole multiple panel track system for a window covering assembly 100.

FIG. 11 displays a cross-sectional view of track support 120 with track carriers 122, 124 and 126 positioned within. The second carrier track 124 is nested between first carrier track 122 and third carrier track 126.

The track support 120 has a flat top portion 128. Each carrier track has a carrier horizontal oblong rectangular receiver portion 130 adjacent and perpendicular to a vertical, oblong, rectangular, slotted portion 132. With the second carrier track 124, the carrier receiver portion 130 is adjacent to the top portion 128. With first carrier track 122 and third carrier track 126, a slotted portion 132 is adjacent to flat top portion 130. The structure permits the carrier receiver portion 130 of each to be adjacent to slotted portion 132, of second carrier track 124.

Thus, second carrier track 124 is nested between first carrier track 122 and third carrier track 126. Located adjacently to slotted portion 132 on the sides of the track support 120 are two C-shaped arm openings 192 which accept the arms 162 of the end cap 200.

From each of first carrier track 122, second carrier track 124 and third carrier track 126 is suspended a curtain panel 134. Positioned on the bottom of and within first carrier track 122 is first panel holder 136. Likewise, second carrier track 124 contains second panel holder 138 and third carrier track 126 contains third panel holder 140.

Each of first panel holder 136, second panel holder 138 and third panel holder 140 supports a curtain panel 134, also shown in FIG. 1, FIG. 2 and FIG. 3. As first carrier track 122, second carrier track 124 and third carrier track 126 move within track support 120, curtain panel 134 is in a deployed position as shown in FIG. 1. The curtain panels 134 on second panel holder 138 and third panel holder 140 move within track support 120 and the respective carrier tracks from a deployed position to a retracted position and points therebetween.

Figure 12:
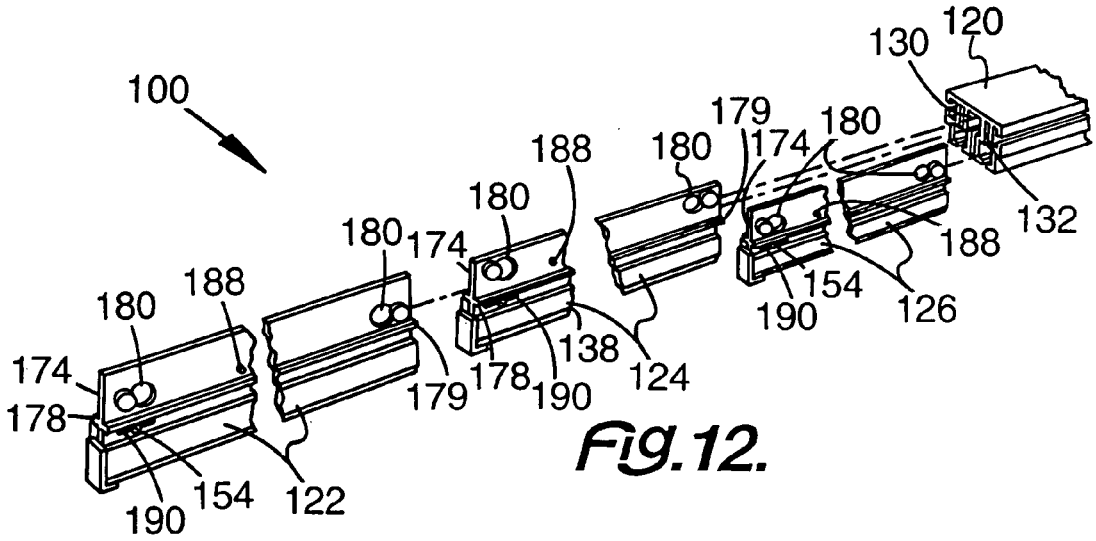
FIG. 12 depicts an exploded view of the sole multiple panel track system for a window covering assembly 100 of this invention.
Figure 13:
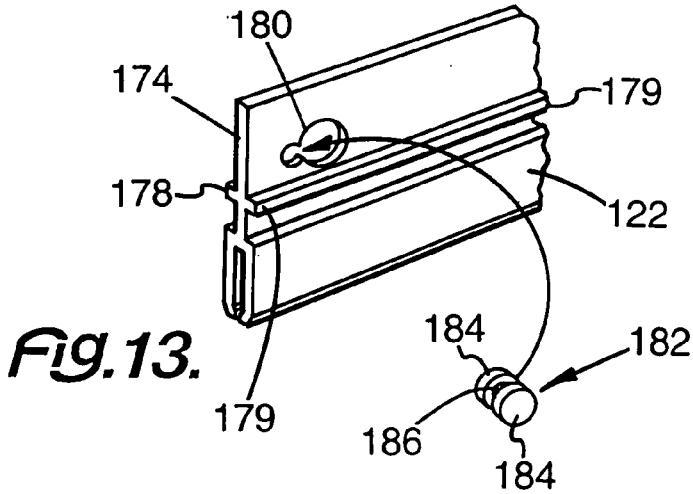
FIG. 13 depicts a perspective view of carrier 122 for the sole multiple panel track system for a window covering assembly 100 of this invention.
Figure 14:
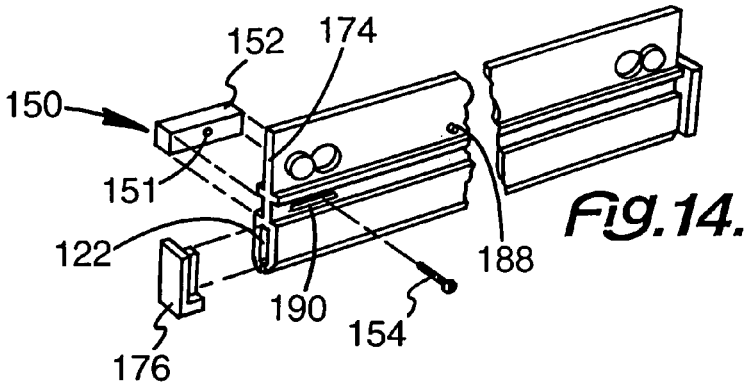
FIG. 14 depicts an exploded perspective view of carrier 118 for the multiple panel track system for a window covering assembly 100 of this invention.

Adding FIG. 12, FIG. 13 and FIG. 14 into consideration, the carrier tracks 122, 124 and 126 include a rectangular plane spine 174. On the bottom of the carrier tracks are curtain panel holders 136, 138 and 140 respectively with curtain cap 176. Panel holders 136, 138 and 140 are square u-shapes with the ends pinched together. The base of the panel holder is connected to and perpendicular to the spine 174 of the carrier track. Catch assembly 150 is located directly above the panel holder with the catch screw 154 inserted into an orifice 190 within the spine 174, then block aperture 151 in catch block 152.

In the first carrier track 122 and third carrier track 126, the orifice 190 is a slot that allows for the carrier to extend beyond the end of the track support 120 to facilitate the use of the sole multiple panel track system for a window covering assembly 100 in an odd-sized window. In the second carrier track 124, the orifice 190 is a circular opening.

On the spine directly above the catch assembly 150 is the carrier ridge 178 which is positioned directly below the bottom of the track support 120 when the track assembly is inserted into the track support. The carrier ridge 178 has two rectangular protrusions 179 extending from the sides of the carrier spine 174 at the same position on the spine 174.

Located at each end of the carrier tracks are wheel mount apertures 180 which comprises a smaller circular orifice in the rectangular spine 174 located close to the end of the carrier track with a larger circular orifice located more toward the center of the carrier intersecting the smaller orifice. Inserted into the wheel mount aperture 180 is wheel unit 182, which comprises two wheels 184 held in position by wheel axle shaft 186. The wheel unit 182 of the carrier tracks traverses the receiver portion 130 of the track assembly 120.

The spine 174 of the carrier tracks traverses the slotted portion 132 of the track assembly 120. Located in the center of the carrier track is glide pin 188 which is a small circular protrusion from the spine of the carrier track at the same height as the bottom of the wheel unit. Glide pin 188 in cooperation with the carrier ridge 178 prevents vertical movement of the carrier tracks within the track support 120.

Figure 15:
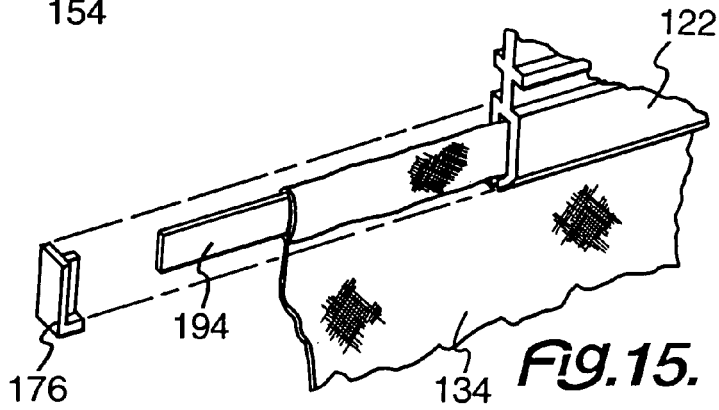
FIG. 15 depicts a perspective view of carrier 118 with a curtain rod therein for sole multiple panel track system for a window covering assembly 100 of this invention.
Figure 16:
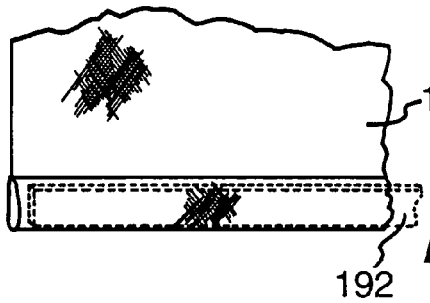
FIG. 16 depicts a front plan view of curtain panel 134 with weight 192 therein for sole multiple panel track system for a window covering assembly 100 of this invention.
Figure 17:
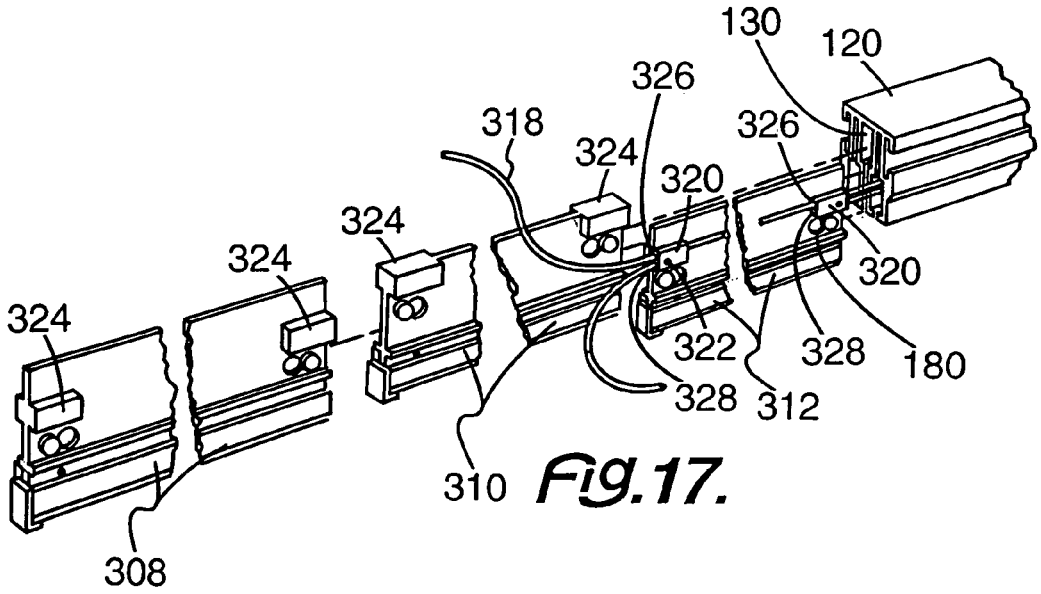
FIG. 17 depicts an exploded view of left side of pulley system 314 of the sole multiple panel track system for a window covering assembly 300 of this invention.
Figure 18:
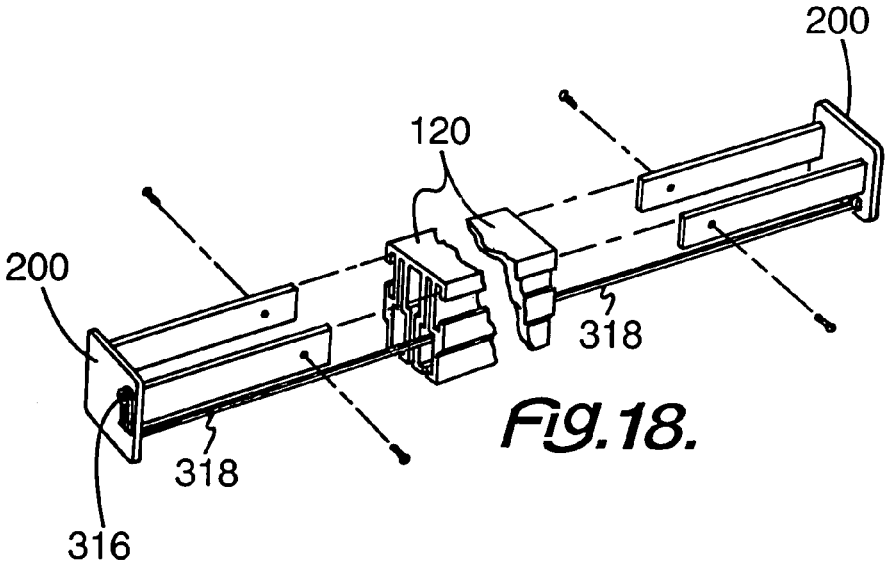
Figure 19:
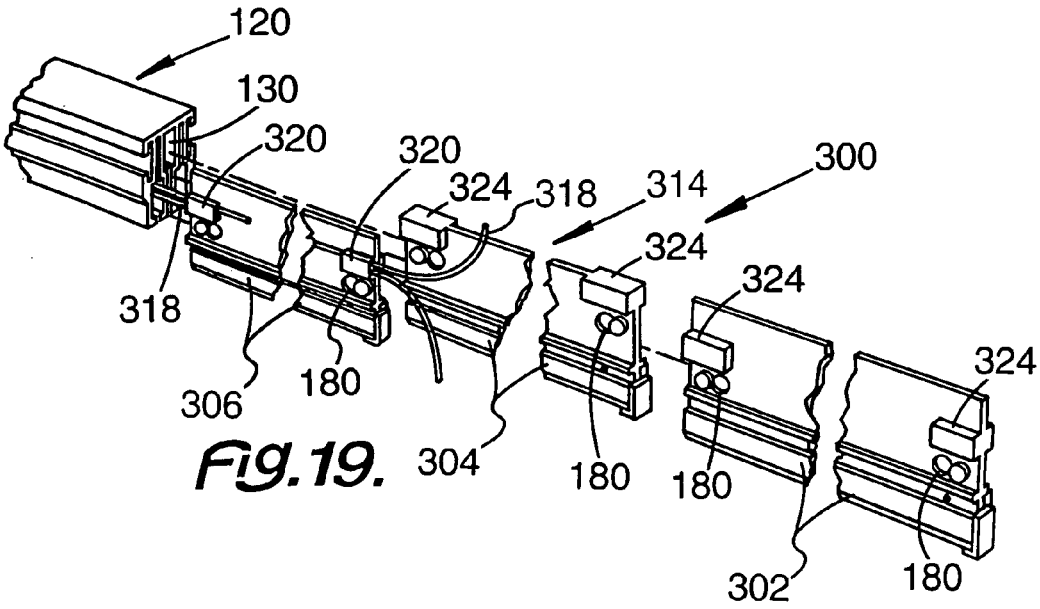
FIG. 19 depicts an exploded view of right side of pulley system 314 of the multiple panel track system for a window covering assembly 300 of this invention.
Figure 20:
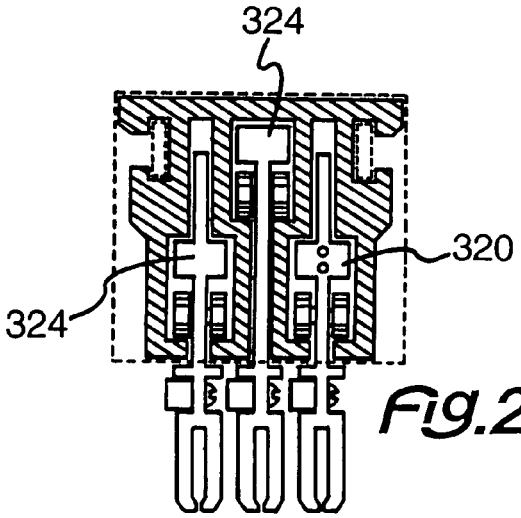
FIG. 20 depicts an end partially cross-sectioned view of center pull cord sleeve 320.
Figure 21:
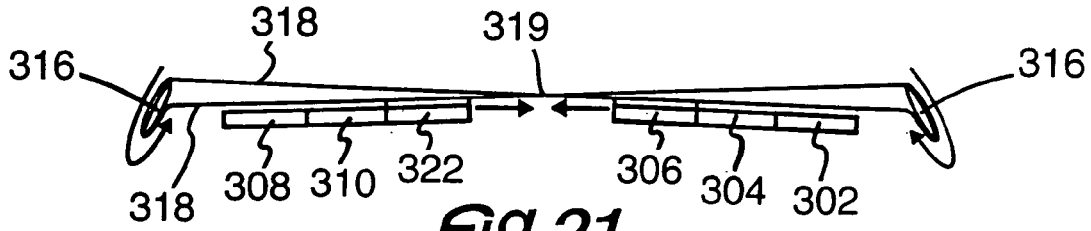
FIG. 21 depicts a top plan view of pulleys 316 moving toward the deployed position of FIG. 23.
Figure 22:
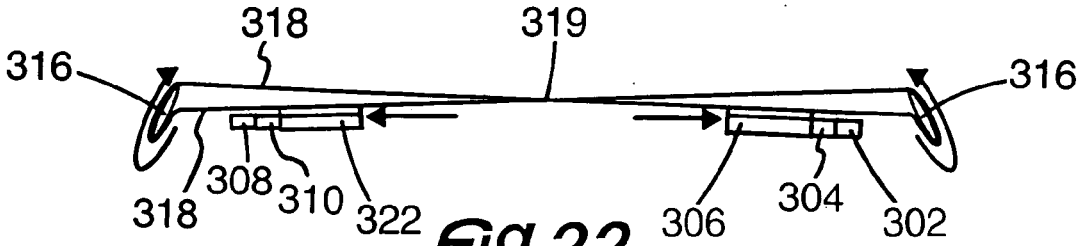
FIG. 22 depicts a top plan view of pulleys 316 moving toward the retracted position of FIG. 25.

FIG. 15 shows curtain rod 194 placed within the sleeve of curtain panel 134, and inserted into first panel holder 134 on first track carrier 122. Curtain cap 176 is then inserted into the end of first panel 134 to lock curtain rod 194 within. Combined with FIG. 16, curtain panel 134 has a weight 192 placed in the bottom hem to force the curtain panel 134 to hang in a desired fashion or rigidly.

FIG. 17, FIG. 18, FIG. 19, FIG. 20, FIG. 21 and FIG. 22 combine to show a preferred embodiment of the dual multiple panel track system for a window covering assembly 300. This version contains six track assemblies, with three track assemblies mounted on each end of the track. The track assemblies deploy toward the center from each side, meeting in the middle when the track assemblies are completely deployed. Track assemblies 302, 304 and 306 deploy from the right end of the track support 120 with track assembly 306 deploying close to the center. Carrier tracks 308, 310 and 312 deploy from the left side of track support 120 with carrier track 312 deploying close to the center.

To assist the dual multiple panel track system for a window covering assembly 300 in the deployment of the six track assemblies, a pulley system is enclosed within the track support 120. The pulley system contains a pulley 316; a pulley cord 318; cord sleeves 320 and a locking screw 322. Pulley cord 319 preferably has a cross-over point 319 centrally located between each pulley 316, which pulleys 316 are on oppositely disposed ends of dual triple track window covering assembly 300.

The cord sleeves 320 are rectangular blocks with two apertures centered on the block that allow the cord to pass through. Two cord sleeves 320 are mounted on track assembly 306 and carrier 312. The cord sleeves 320 are placed on each end of the carrier tracks 308, 310 and 312 directly above the wheel mount unit aperture 180.

To facilitate the placement of the track assembly 306 and corresponding carrier 312 into the track support 120, all three receiver portions 130 of the track support 120 are enlarged. To make track carriers 302 and 308 sit snugly into the track with the elongated receiver portion 130, spacing blocks 324 having the same diameter as the cord sleeve 320 are placed on the corresponding positions on carrier track 302 and 308 as the cord sleeves 320 are placed on track carriers 306 and 312.

Spacing blocks 324 are also placed on the top of track carriers 304 and 310 directly above the wheel mount unit aperture 180. These spacing blocks compensate for the elongated receiver portion 130 in the center of the track support 120. Cord 318 is secured to the bottom aperture of the cord sleeve 320 that is mounted on the right end of the carrier track 306.

Cord 318 travels through the receiver portion 130 of track support 120 to the cord sleeve mounted on the left-hand side of carrier track 312. The cord 318 passes through the top aperture 326 of this cord sleeve 320 to the adjacent cord sleeve 320 mounted on the right side of carrier track 312. Cord 318 then passes the top aperture 326 of this cord sleeve 320, and through the top receiver portion 130 of the carrier track to pulley 316 which is located in the right adjustable end cap 200.

After passing though the pulley 316, the cord 318 travels back through the receiver portion 130; through the right bottom apertures 328 of the cord sleeves 320 mounted on the carrier track 312, through a locking screw 322 mounted on the center of carrier track 312 and then through the bottom aperture 328 of the cord sleeve 318 mounted on the left side of the carrier track 312. From here the cord 318 travels through receiver portion 130 to the top aperture on the cord sleeve 320 mounted on the right side of the carrier track 306.

The cord 318 travels passes through receiver portion 130 to the cord sleeve 318 mounted on the left side of carrier track 306; through the top aperture of cord sleeve 320; travels further down the receiver portion 130 to the left end cap 200.

The cord 318 passes through a cord pulley 314 mounted on the left end cap 200 and back through the other receiver portion 130 of the track carrier 120, and then to the bottom aperture 328 of the sleeve cord mounted on the left side of carrier track 306. From here the cord travels to the bottom aperture 328 of the sleeve cord 318 mounted on the right side of carrier track 306, where it is secured.

Figure 23:
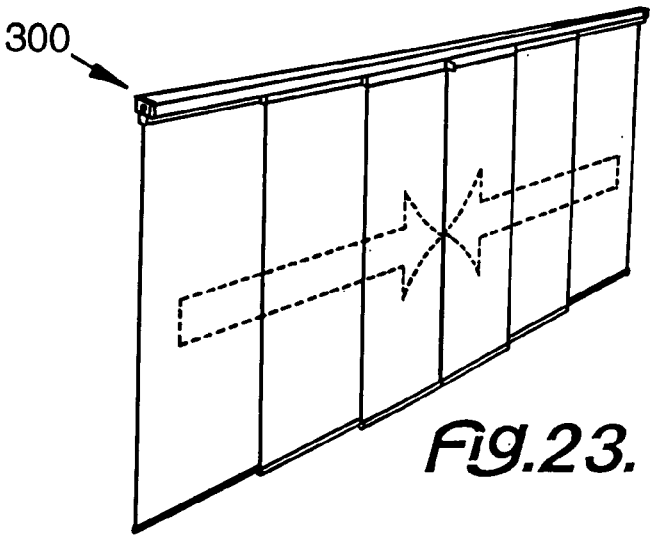
FIG. 23 depicts a perspective view of the dual multiple panel track system for a window covering assembly 300 of this invention showing six curtain panels 134 fully deployed.
Figure 24:
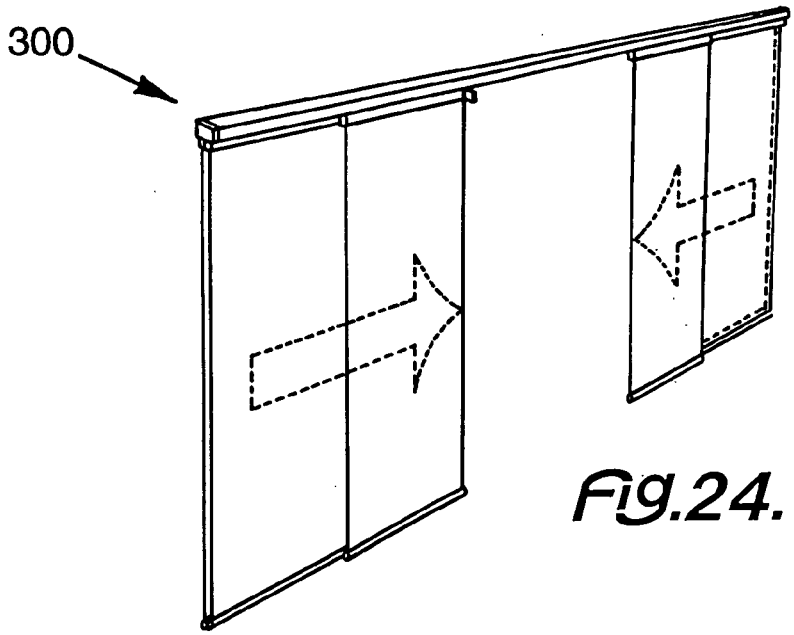
FIG. 24 depicts a perspective view of the dual track window covering assembly 300 of this invention showing six panels 134 partially deployed.
Figure 25:
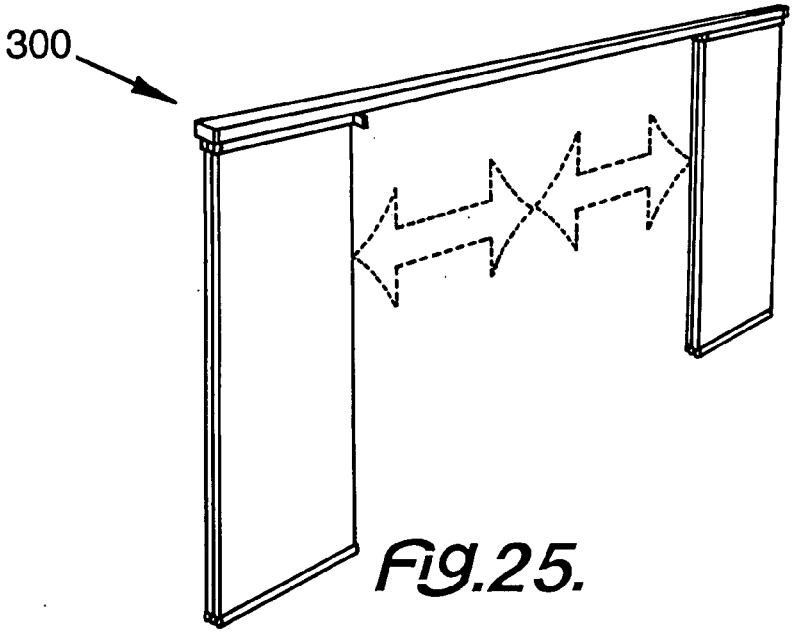
FIG. 25 depicts a perspective view of the dual multiple panel track system for a window covering assembly 300 of this invention showing six panels 134 completely retracted.

FIG. 23 shows dual multiple panel track system for a window covering support 300 with the carrier tracks fully deployed. FIG. 24 displays dual multiple panel track system for a window covering support 300 with the carrier tracks partially deployed. FIG. 25 displays dual multiple panel track system for a window covering support 300 completely retracted.

Figure 26:
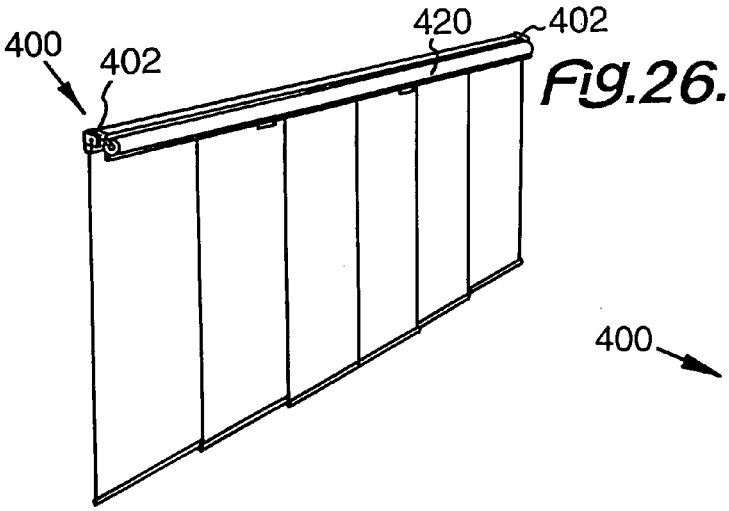
FIG. 26 depicts a perspective view of shaded multiple panel track system for a window covering assembly 400 of this invention, with the blind 402 mounted thereon in an up position.
Figure 27:
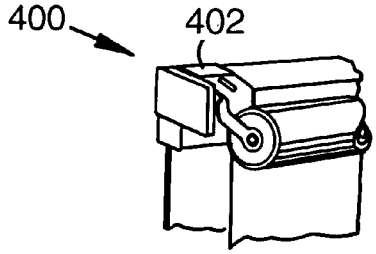
FIG. 27 depicts a close-up perspective view of shaded multiple panel track system for a window covering assembly 400 of this invention, with the blind 402 mounted thereon.
Figure 28:
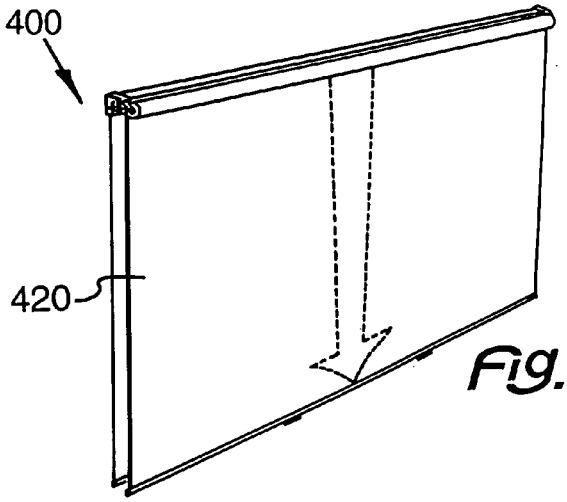
FIG. 28 depicts a perspective view of shaded multiple panel track system for a window covering assembly 400 of this invention, with the blind 402 mounted thereon in a down position.

FIG. 26, FIG. 27 and FIG. 28 combine to depict a shaded multiple panel track system for a window covering support preferred embodiment 400. This embodiment features the mounting of a shade 420 in brackets 402. FIG. 27 shows shade mounting brackets 402 mounted at each end of shaded multiple panel track system for the window covering support preferred embodiment 400. FIG. 28 shows shaded multiple panel track system for a window covering 400 with shade 420 fully deployed.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A window covering assembly having a track system and a window covering comprising:

(a) the track system including a nested system adapted to support the window covering;
(b) the window covering including at least two panels;
(c) the nested system including at least two tracks;
(d) the at least two tracks including at least a first track and a second track;
(e) the at least two panels including at least a first panel and a second panel;
(f) the first track being adapted to receive the first panel;
(g) the second track being adapted to receive the second panel;
(h) the track system being sufficiently narrow to fit an architectural opening in a building;
(i) the at least two tracks being three tracks;
(j) the three tracks including the first track, the second track and a third track;
(k) the second track being nested between the first track and the third track;
(l) the at least two panels including the first panel, the second panel, and a third panel;
(m) the first panel having a first carrier secured thereto;
(n) the second panel having a second carrier secured thereto;
(o) the third panel having a third carrier secured thereto;
(p) the first track receiving the first carrier;
(q) the second track receiving the second carrier;
(r) the third track receiving the third carrier;
(s) the first carrier being slidably mounted in the first track;
(t) the second carrier being slidably mounted in the second track;
(u) the third carrier being slidably mounted in the third track;
(v) the first carrier, the second carrier, and the third carrier being alternatively movable between a deployed position and a retracted position;
(w) the covering material being at least one material selected from the group consisting of a transparent material, a translucent material, and an opaque material;
(x) the first carrier, the second carrier, and the third carrier each having a guide cam and a locking cam thereon;
(y) the guide cam and the locking cam limiting movement of the first carrier, the second carrier, and the third carrier; and
(z) the guide cam and the locking cam positioning the window covering.

2. The window covering assembly of claim 1 further comprising:

(a) the first track receiving the first carrier and a fourth carrier;
(b) the second track receiving the second carrier and a fifth carrier;
(c) the third track receiving the third carrier and a sixth carrier;
(d) the first carrier and the fourth carrier being movable in opposing directions;
(e) the second carrier and the fifth carrier being movable in opposing directions;
(f) the third carrier and the sixth carrier being movable in opposing directions;
(g) the first carrier, the second carrier and third carrier being movable in a first single direction; and
(h) the fourth carrier, the fifth carrier and sixth carrier being movable in a second single direction.

3. The window covering assembly of claim 2 further comprising:

(a) a center pull unit cooperating to move the first carrier, the second carrier, the third carrier, the fourth carrier, the fifth carrier and the sixth carrier;
(b) the center pull permitting movement of the first carrier within the first track, the second carrier within the second track, the third carrier within the third track, the fourth carrier within the first track, the fifth carrier within the second track and the sixth carrier within the third track; and
(c) a fixed reel and a movable wheel cooperating in the center pull unit to provide movability.

4. The window covering assembly of claim 3 further comprising:

(a) the at least one carrier having a track mount and a curtain receiver cooperating to form the carrier;
(b) the track mount fitting into the at least one track; and
(c) the curtain receiver supporting the at least one panel.

5. The window covering assembly of claim 4 further comprising:

(a) an end cap being slidably mounted at an end of the multiple panel track system for a window; and
(b) the end cap providing an adjustable extension for the multiple panel track system for a window.

6. The window covering assembly of claim 4 further comprising:

(a) a center pulling device operating the multiple panel track system for a window covering assembly;
(b) the center pulling device including an operating cord; and
(c) the operating cord traveling freely from the first carrier to the second carrier and to the third carrier.

7. The window covering assembly of claim 6 further comprising:

(a) a triangularly shaped wing supporting the window covering assembly;
(b) a catch assembly being mounted in the nested system;
(c) the catch assembly supporting the carriers; and
(d) the catch assembly including a movable catch cap and a fixed pull cap.

8. The window covering assembly of claim 7 further comprising:

(a) the nested system including a curtain rod;
(b) a pulley system being within the nested system;
(c) the pulley system having a pulley cooperating with a cord, two cord sleeves to support the cord and a locking screw to support the cord sleeve; and (d) two spacing blocks having a diameter similar to the diameter of the cord sleeves.

9. A window covering assembly having a track system and a window covering comprising:

(a) the track system including a nested system adapted to support the window covering;

(b) the window covering including three panels;

(c) the nested system including a first track, a second track and a third track;

(d) the three panels including a first panel, a second panel and a third panel;

(e) the first track being adapted to receive the first panel;

(f) the second track being adapted to receive the second panel;

(g) the third track being adapted to receive the third panel;

(h) the track system being sufficiently narrow to fit an architectural opening in a building;

(i) the nested system permitting the first track, the second track and a third track to be compact and narrow;

(j) the second track being nested between the first track and the third track;

(k) the first panel having a first carrier secured thereto;

(l) the second panel having a second carrier secured thereto;

(m) the third panel having a third carrier secured thereto;

(n) the first track receiving the first carrier;

(o) the second track receiving the second carrier;

(p) the third track receiving the third carrier;

(q) the first carrier being slidably mounted in the first track;

(r) the second carrier being slidably mounted in the second track;

(s) the third carrier being slidably mounted in the third track;

(t) the first carrier, the second carrier, and the third carrier being alternatively movable between a deployed position and a retracted position;

(u) the covering material being at least one material selected from the group consisting a transparent material, a translucent material, and an opaque material;

(v) the first carrier, the second carrier, and the third carrier each having a guide cam and a locking cam thereon;

(w) the guide cam and the locking cam limiting movement of the first carrier, the second carrier, and the third carrier; and (x) the guide cam and the locking cam positioning the window covering.

10. The window covering assembly of claim 9 further comprising:

(a) the first track receiving the first carrier and a fourth carrier;

(b) the second track receiving the second carrier and a fifth carrier;

(c) the third track receiving the third carrier and a sixth carrier;

(d) the first carrier and the fourth carrier being movable in opposing directions;

(e) the second carrier and the fifth carrier being movable in opposing directions;

(f) the third carrier and the sixth carrier being movable in opposing directions;

(g) the first carrier, the second carrier and third carrier being movable in a first single direction; and (h) the fourth carrier, the fifth carrier and sixth carrier being movable in a second single direction.

11. The window covering assembly of claim 10 further comprising:

(a) a center pull unit cooperating to move the first carrier, the second carrier, the third carrier, the fourth carrier, the fifth carrier and the sixth carrier;

(b) the center pull permitting movement of the first carrier within the first track, the second carrier within the second track, the third carrier within the third track, the fourth carrier within the first track, the fifth carrier within the second track and the sixth carrier within the third track;

(c) a fixed reel and a movable wheel cooperating in the center pull unit to provide movability;

(d) the at least one carrier having a track mount and a curtain receiver cooperating to form the carrier;

(e) the track mount fitting into the at least one track; and (f) the curtain receiver supporting the at least one panel.

12. A window covering assembly having a track system and a window covering comprising:

(a) the track system including a nested system adapted to support the window covering;

(b) the track system including a first track, a second track and a third track; and (c) the first track being adapted to receive a first panel;

(d) the second track being adapted to receive a second panel;

(e) the third track being adapted to receive a third panel;

(f) the track system being sufficiently narrow to fit an architectural opening in a building;

(g) the first panel, the second panel and the third panel being alternatively movable between a deployed position and a retracted position;

(h) the second track being nested between the first track and the third track;

(i) the first panel having a first carrier secured thereto;

(j) the second panel having a second carrier secured thereto;

(k) the third panel having a third carrier secured thereto;

(l) the first track receiving the first carrier;

(m) the second track receiving the second carrier;

(n) the third track receiving the third carrier;

(o) the first carrier being slidably mounted in the first track;

(p) the second carrier being slidably mounted in the second track;

(g) the third carrier being slidably mounted in the third track;

(r) the first carrier, the second carrier, and the third carrier being alternatively movable between the deployed position and the retracted position;

(s) the covering material being at least one material selected from the group consisting a transparent material, a translucent material, and an opaque material;

(t) the first carrier, the second carrier, and the third carrier each having a guide cam and a locking cam thereon;

(u) the guide cam and the locking cam limiting movement of the first carrier, the second carrier, and the third carrier; and (v) the guide cam and the locking cam positioning the window covering.

* * * * *